US005650586A

United States Patent [19]

Balbo et al.

[11] Patent Number: 5,650,586

[45] Date of Patent: Jul. 22, 1997

[54] ANTI BUCKLE FITTING

[75] Inventors: Patrick Balbo; Philippe Grelat, both of Bourges; Guy Malassenet, Pigny; Fabienne Mandereau, Sainte-Thorette, all of France

[73] Assignee: Giat Industries, Versailles, France

[21] Appl. No.: 437,628

[22] Filed: May 9, 1995

[30] Foreign Application Priority Data

Jun. 16, 1994 [FR] France ..... 94-07358

[51] Int. Cl.[6] ..... F41A 13/12; F41A 21/44

[52] U.S. Cl. ..... 89/14.05; 89/14.1; 89/16

[58] Field of Search ..... 89/14.05, 14.1, 89/16

[56] References Cited

U.S. PATENT DOCUMENTS

| | | | |
|---|---|---|---|
| 3,075,314 | 1/1963 | Bakker | 89/14.1 |
| 3,090,150 | 5/1963 | Stoner | 89/14.1 |
| 5,062,346 | 11/1991 | Hansen et al. | 89/14.1 |

FOREIGN PATENT DOCUMENTS

| | | | |
|---|---|---|---|
| 708 004 | 4/1968 | Belgium . | |
| 8964 64 | 8/1983 | Belgium . | |
| 0 183 432 | 6/1986 | European Pat. Off. . | |
| 0 307 308 | 3/1989 | European Pat. Off. . | |
| 124186 | 3/1949 | Sweden | 89/14.1 |

*Primary Examiner*—Michael J. Carone
*Assistant Examiner*—Matthew J. Lattig
*Attorney, Agent, or Firm*—Robbins, Berliner & Carson, LLP

[57] ABSTRACT

An anti-buckle fitting for a large caliber gun barrel, the fitting being constituted by an envelope that surrounds the barrel at a distance therefrom and of a length that is substantially equal to the outside portion of the barrel, the fitting comprising a front ring fixed near the free end of the barrel and a back ring fixed near the fume extractor of the barrel, and wherein the envelope is in the form of two half-shells assembled together by link means.

15 Claims, 5 Drawing Sheets

ANTI BUCKLE FITTING

The technical field of the present invention is that of anti-buckle fittings for large caliber gun barrels.

BACKGROUND OF THE INVENTION

Modern gun barrel design implies the use of an anti-buckle fitting, i.e. an additional part that co-operates with the barrel proper to prevent the barrel curving. A barrel serves to launch projectiles, it is a part that is relatively long, and it is fixed at one end to a gun mount. It must therefore withstand, in particular, the action of its own weight, the stresses that result from firing, and atmospheric conditions.

Three techniques are used at present for making anti-buckle fittings: casting; all-welding; and wire-binding; each technique being followed by special machining to ensure that the bearing surfaces are aligned after assembly. This therefore constitutes a major drawback given the dimensions of the parts to be manipulated. Also, given the recoil accelerations that occur on firing, the dimensioning of anti-buckle fittings makes it necessary for them to be limited in length for questions of mechanical strength, or else to increase their wall thickness, and thus the total suspended mass.

An anti-buckle fitting is intended mainly for limiting curvature, i.e. deformation of the barrel away from its axis and due to external conditions: e.g. rain or heating, modifying temperature distribution. Thus, a temperature gradient between the top and the bottom of the barrel will deform it, thereby spoiling shooting accuracy.

Patent FR-A-1,445,546 describes a device for preventing barrel buckling in which an envelope is disposed around the barrel at a certain distance therefrom. That establishes a fluid jacket within which any temperature differences give rise to convection phenomena that re-establish uniformity of temperature. Nevertheless, no specific structure is described for fixing the envelope on the barrel.

OBJECT AND SUMMARY OF THE INVENTION

The object of the present invention is to provide an anti-buckle fitting enabling the drawbacks of the prior art to be mitigated by reducing its mass and by minimizing the temperature gradient around the barrel.

To this end, the invention provides an anti-buckle fitting for a large caliber gun barrel, the fitting being constituted by an envelope that surrounds the barrel at a distance therefrom and of a length that is substantially equal to the outside portion of the barrel, the fitting comprising a front ring fixed near the free end of the barrel and a back ring fixed near the fume extractor of the barrel, and wherein the envelope is in the form of two half-shells assembled together by link means.

According to a characteristic of the invention, each ring is provided with a groove for receiving the envelope.

According to other characteristics of the invention:

- the two half-shells are provided on their adjacent edges with connection means constituted by an H-section bar, for example;
- each half-shell is provided with external and/or internal reinforcing means, the internal reinforcing means being constituted by a T-section bar, and the external reinforcing means being constituted by a bar having an Ω-shaped right section, for example; and
- each half-shell is provided with holes for allowing air to flow between the inside volume defined by the half-shells and the barrel, and the outside.

According to another characteristic of the invention, the anti-buckle fitting includes at least one intermediate ring disposed substantially in the middle of the envelope and provided on either side with respective grooves receiving the ends of two envelope elements, said ring being applied directly to the barrel by clamping.

According to another characteristic of the invention, an insulating washer, e.g. made of rubber, is disposed between the intermediate ring and the barrel.

In a preferred embodiment, two intermediate rings are provided, each intermediate ring being provided with longitudinal holes putting into mutual communication the sub-assemblies defined by the envelope, the front rings, the back rings, and the intermediate ring(s).

In general, each half-shell has a section of semicircular outline, the envelope is tapering in shape with its larger base being constituted by its back ring, and the half-shells, and the H-, T-, and Ω-section bars are all made from metal sheet using a folding technique.

An advantage of the present invention lies in implementing manufacturing techniques that are simple to the exclusion of casting, machining, or all-welding techniques, thereby reducing manufacturing costs.

Another advantage of the invention lies in the fact that the fitting withstands recoil accelerations greater than 5000 meters per second squared ($m/s^2$).

Yet another advantage of the invention lies in the possibility of replacing the fitting in part or in full without altering the characteristics of the barrel itself.

Yet another advantage of the invention lies in the fact that the elements of the fitting are identical in structure.

BRIEF DESCRIPTION OF THE DRAWINGS

Other characteristics and advantages of the invention will be better understood on reading the additional description below given with reference to the accompanying drawings, in which.

MORE DETAILED DESCRIPTION

Figure 1:
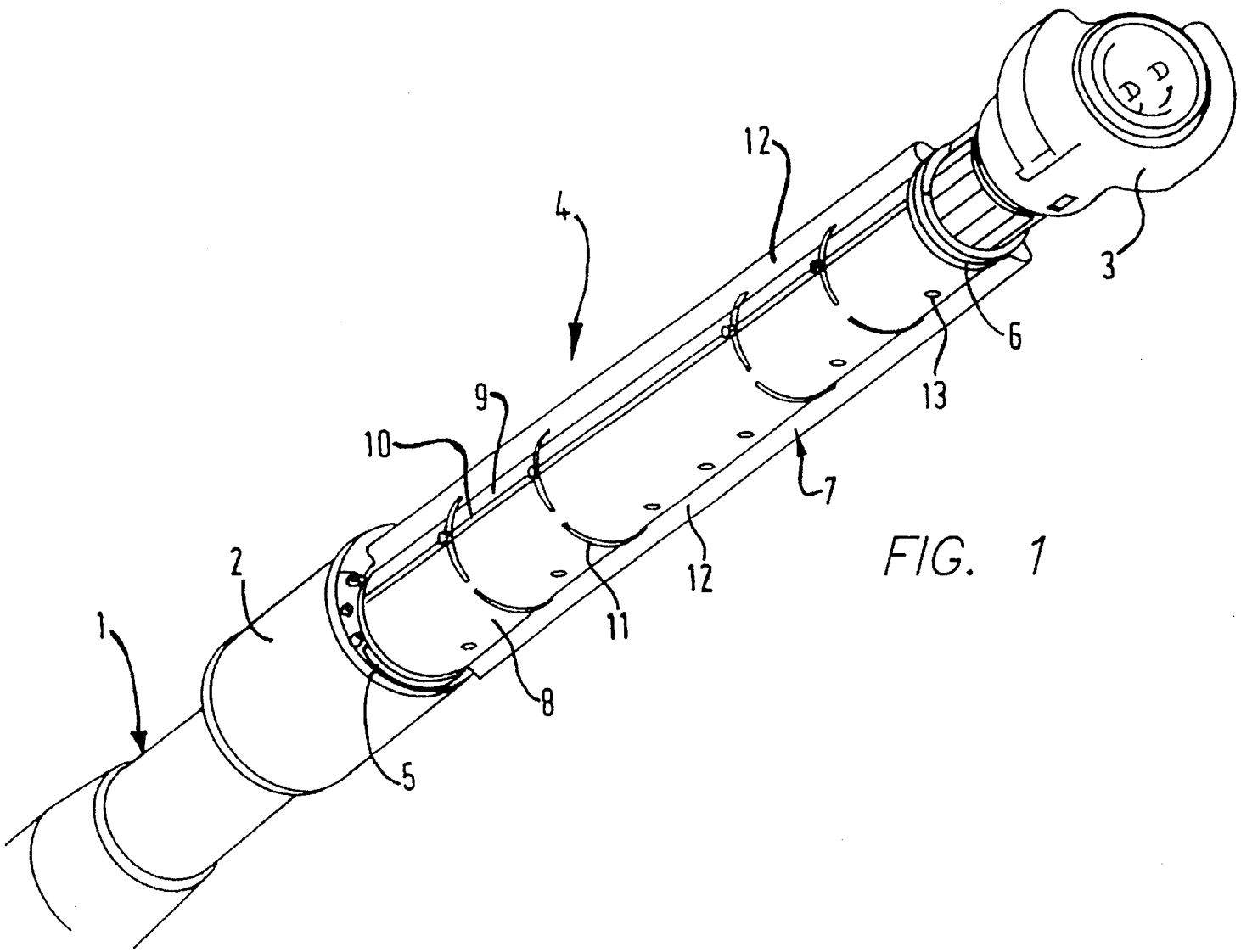
FIG. 1 is a view of a first embodiment of a fitting of the invention.

FIG. 1 shows a gun barrel 1 provided with a fume extractor 2 and terminated at the front by a muzzle brake 3. The barrel 1 extends from the gun chamber in conventional manner and does not need describing in greater detail. Nevertheless, it should be observed that it is generally tapering in shape from the fume extractor 2 to the muzzle brake 3, with its larger base being at its fume extractor end. In the intermediate portion between the fume extractor 2 and the muzzle brake 3 (or a free front end if the barrel 1 does not have a muzzle brake), it is conventional to place an anti-buckle fitting 4 whose main purpose is to limit deformation of the barrel that could degrade performance of the weapon. The longer the intermediate portion, the greater the performance required of the anti-buckle fitting, thereby giving rise to an increase in the mass of the projecting portion of the barrel. The recoil accelerations that take place make drawbacks associated with mass even worse and degrade the mechanical strength of the assembly comprising the barrel and its anti-buckle fitting.

According to the invention, the anti-buckle fitting 4 has a back ring 5 and a front ring 6, between which an envelope 7 is disposed. The back ring 5 is guided on a bearing surface formed on the fume extractor 2. The front ring 6 is held in a groove formed in the barrel. The front ring 6 can be fixed at an arbitrary distance away from the back ring 5 as a function of the characteristics desired by the person skilled in the art. In the invention, it is preferable to fix the front ring 6 as close as possible to the muzzle brake 3. The envelope 7 is placed at a distance from the barrel 1 and may surround the barrel completely or partially. In FIG. 1, the envelope 7 surrounds the barrel 1 completely and it has a generally tapering shape analogous to the shape of the barrel, with this particular design being chosen for reasons of convenience. The envelope 7 is made up of two half-shells 8 and 9 that are united by H-shaped connection means 10 on their adjacent edges, and they are held together by collars 11. Each half-shell 8 or 9 may be reinforced by external and/or internal reinforcing means. FIG. 1 shows external reinforcing means 12 constituted by a bar of Ω-shaped section applied by adhesive, rivets, or welding against the outside surface of each half-shell, and holding the collars 11 captive. The length of this bar is substantially equal to the length of the half-shell, bearing against the two rings 5 and 6. These reinforcements enable the strength of the envelope 7 against recoil acceleration to be increased by taking up the forces created by the inertia of the anti-buckle fitting.

In its envelope-facing face, each of the back and front rings 5 and 6 includes a circular groove in which at least a portion of the corresponding end of the envelope 7 is received. The groove 24 in the back ring 5 is visible in FIGS. 3 and 4, and the groove 28 in the front ring 6 is visible in FIG. 4.

The two half-shells 8 and 9 may be positioned arbitrarily relative to the barrel 1. In particular, the two half-shells 8 and 9 may be placed so as to be generally above and below the barrel 1. The lower half-shell 8 may be provided with holes 13 to improve air flow.

Figure 2:
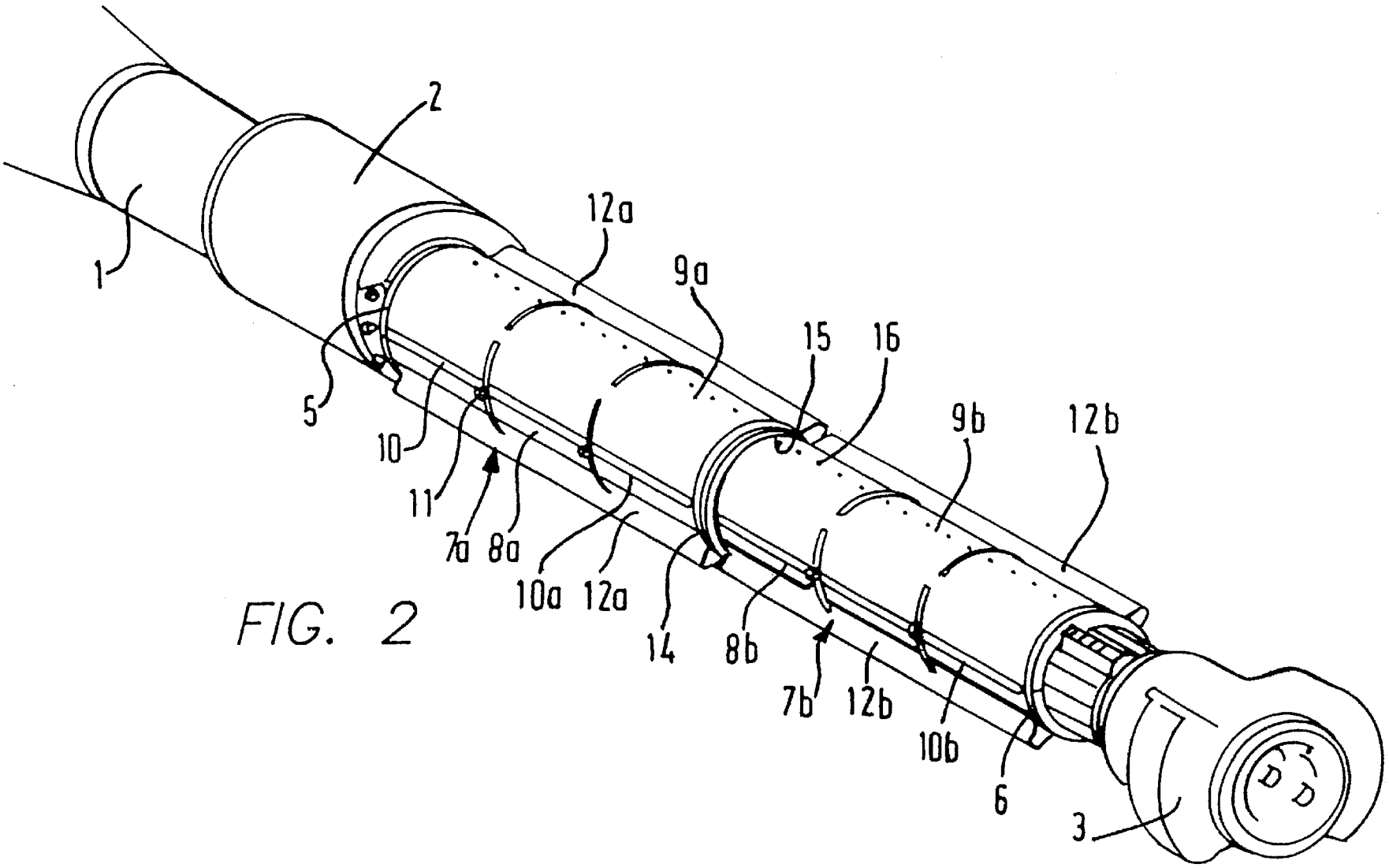
FIG. 2 is a view of a second embodiment of a fitting of the invention.

Another embodiment is shown in FIG. 2 where it can be seen that each half-shell is itself made up of two portions.

This variant can be implemented in particular when the barrel I is very long and of very large caliber, being subjected to very large recoil accelerations (6000g).

The envelope 7 is then made up of two elements 7*a* and 7*b* in line with each other. The element 7*a* is itself made up of two half-shells 8*a* and 9*a* united by collars 11, while the element 7*b* is itself made up of two half-shells 8*b* and 9*b* united by collars 11. To fix the two elements 7*a* and 7*b* together, the back ring 5 of the element 7*b* is guided against the front ring 6 of the element 7*a*, thereby ensuring that the elements 7*a* and 7*b* are guided to be in alignment. The intermediate rings 14 and 15 include bearing faces against which the two elements 7*a* and 7*b* are pressed. As in the preceding embodiment, each element 7*a* and 7*b* includes connection elements 10*a* and 10*b* for connecting together the two half-shells 8*a*, 9*a*, and 8*b*, 9*b* constituting each element, together with reinforcing means 12*a* and 12*b* of Ω-shaped right section. Finally, the upper half-shells 9*a* and 9*b* have holes 16 allowing air to escape through the upper portion of the fitting while nevertheless preventing water from trickling in. These holes are smaller in diameter than the holes 13 of FIG. 1 which in turn serve to dump quickly any liquid that may have been picked up, e.g. while crossing a river.

Figure 3:
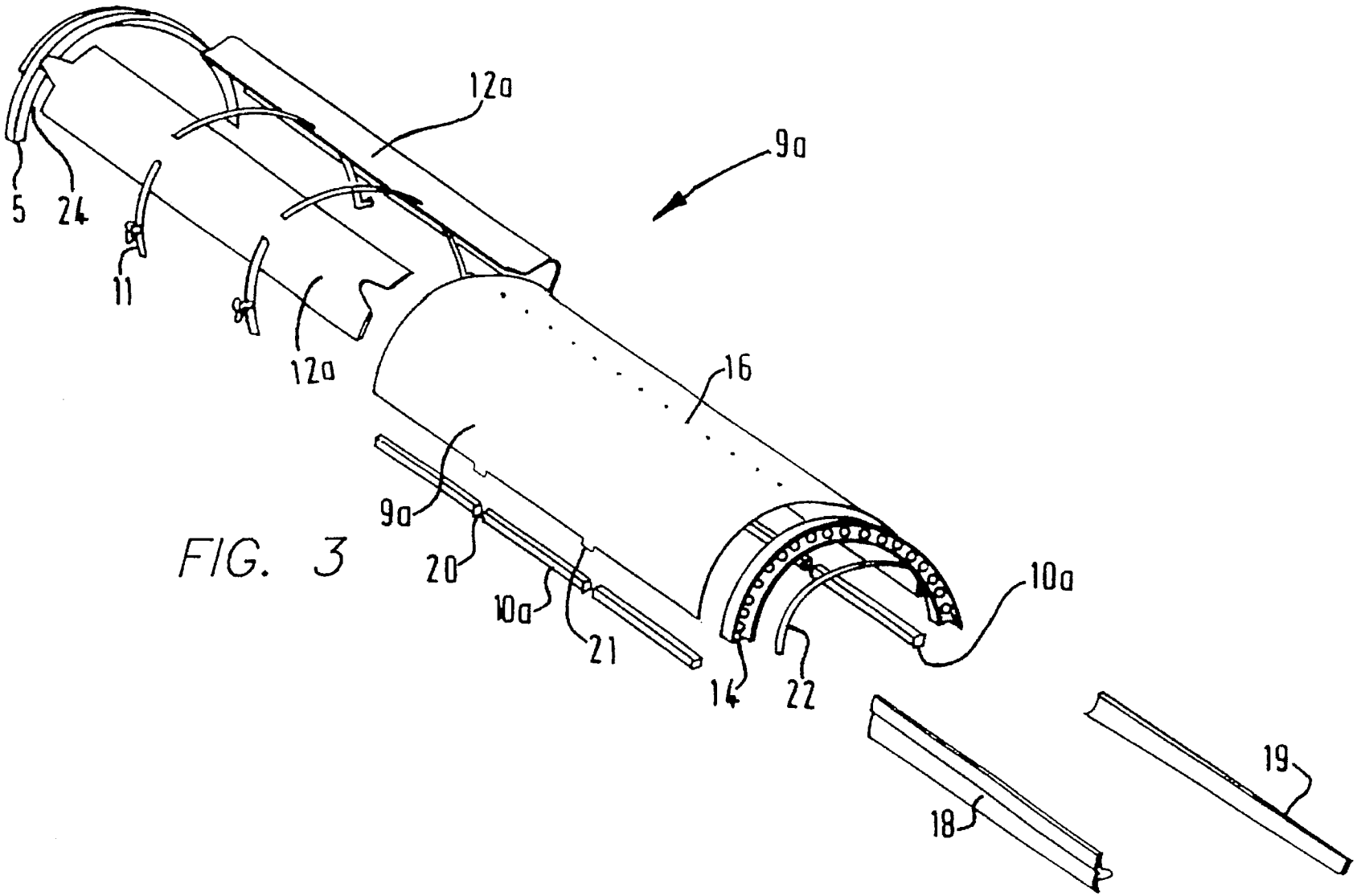
FIG. 3 is an exploded perspective view of a portion of the top half of the FIG. 2 second embodiment of the fitting.

FIG. 3 shows the half-shell 9*a* of the element 7*a* of the envelope of FIG. 2 in greater detail, with the component parts thereof being shown in an exploded view. Specifically, there can be seen the back ring 5, the half-shell 9*a*, and the intermediate ring 14. In this embodiment, the half-shell 9*a* is reinforced on the outside by two bars 12*a* of projecting Ω-shaped right section, and on the inside by two T-shaped bars 18 and 19. The complementary half-shells 8*a* and 9*a* of the element 7*a* are united by two connection means 10*a* in which notches 20 may be formed to co-operate with projecting lugs 21 on the edges of said half-shells. This prevents any relative displacement between the half-shells. In FIG. 3, it can also be seen that the intermediate ring 14 is isolated from the barrel 1 by a washer 22, e.g. a rubber washer. For example, the washer may be stuck to the intermediate ring 12 and serves to prevent inevitable deformations of the barrel 1 being transmitted to the anti-buckle fitting 4, and vice versa. The same applies to the intermediate ring 15 when that is used.

Figure 4:
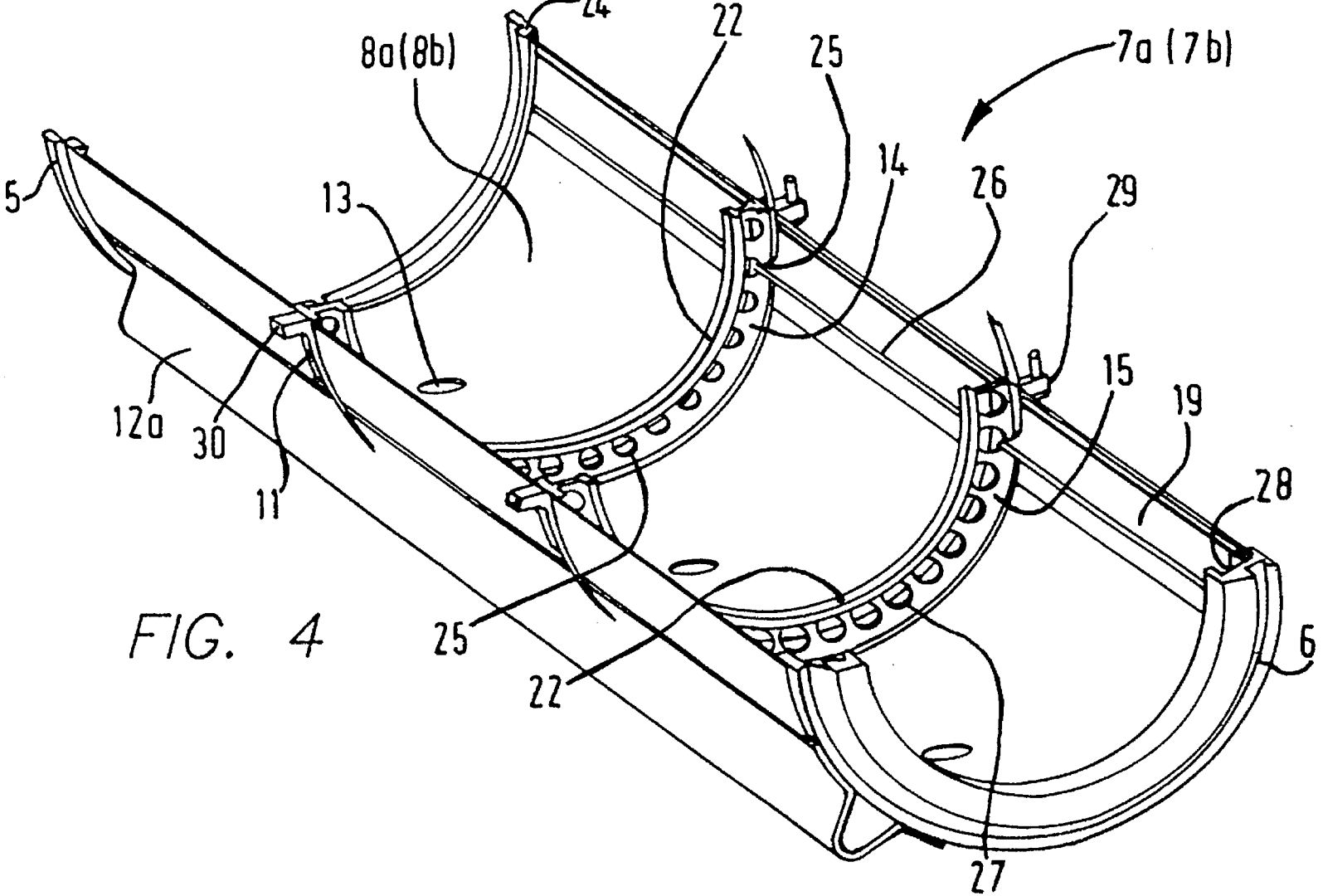
FIG. 4 is a perspective view of the bottom half of the fitting.

FIG. 4 shows envelope element 7*a*, and more particularly the half-shell 8*a* whose component parts are assembled together. It can be seen that the half-shell 8*a* is provided with holes 13 of large diameter for evacuating fluids in operation, with a reinforcing bar 12*a* that projects outwards, and with a T-shaped bar 19 on the inside, the bar 18 being omitted from the figure. The half-shell 8*a* or 8*b* is constituted by a single part that is applied against the intermediate rings 14 and 15. In FIG. 4, it can be seen that the back ring 5 is provided with a groove 24 in which the half-shell 8*a* engages, the end of the bar 19 bearing against the edge of the groove. Each intermediate ring 14 or 15 receives a rubber washer 22. The washer may be placed in a groove formed in the thickness of the ring. Each intermediate ring includes a notch 25 receiving the projecting edge 26 of the bar 19. The intermediate rings 14 and 15 are provided with longitudinal holes 27 to put the subassemblies defined by the envelope into communication with one another. It can also be seen that the front ring 6 includes a groove 28 receiving the half-shell 8*b* and the end of the bar 19. The figure also shows the male portion 29 and the female portion 30 of collars 11 that unite the two half-shells, e.g. by means of a screw.

To further reduce the mass of the anti-buckle fitting, parts 14, 15, 5 and 10*a* which are subject to little stress may be made of aluminum alloy or of plastics material. The solution of the invention makes it possible to increase the usually accepted length of anti-buckle fittings on barrels by about 1.50 meters (m), while reducing mass by more than 20%.

Also, it will be understood that the solution used in the invention makes it possible to keep air around the barrel in a layer which is not subjected to sunlight, nor to wind, nor to precipitation. The uniformity of this layer of air along the entire length of the barrel is ensured by the holes 13 and 16 through the half-shells, and by the holes 25 through the intermediate rings 14 and 15. Given their position on the top generator line of the half-shell, the holes 16 should be small enough to avoid allowing rain water to penetrate, while still being large enough to allow air to be exchanged with the outside, e.g. having a diameter of about 2 mm. Given their position on the bottom generator line of the half-shell, the holes 13 should be large enough, e.g. when fording, to make it possible to dump quickly any water that happens to penetrate into the anti-buckle fitting during the operation. For example, the total surface area of the bottom holes 13 may be equal to or slightly greater than the total surface area of the top holes 16 so that inside the anti-buckle fitting, there will be a flow of air that has the effect of minimizing the temperature gradient between the top and bottom generator lines of the barrel.

Figure 5:
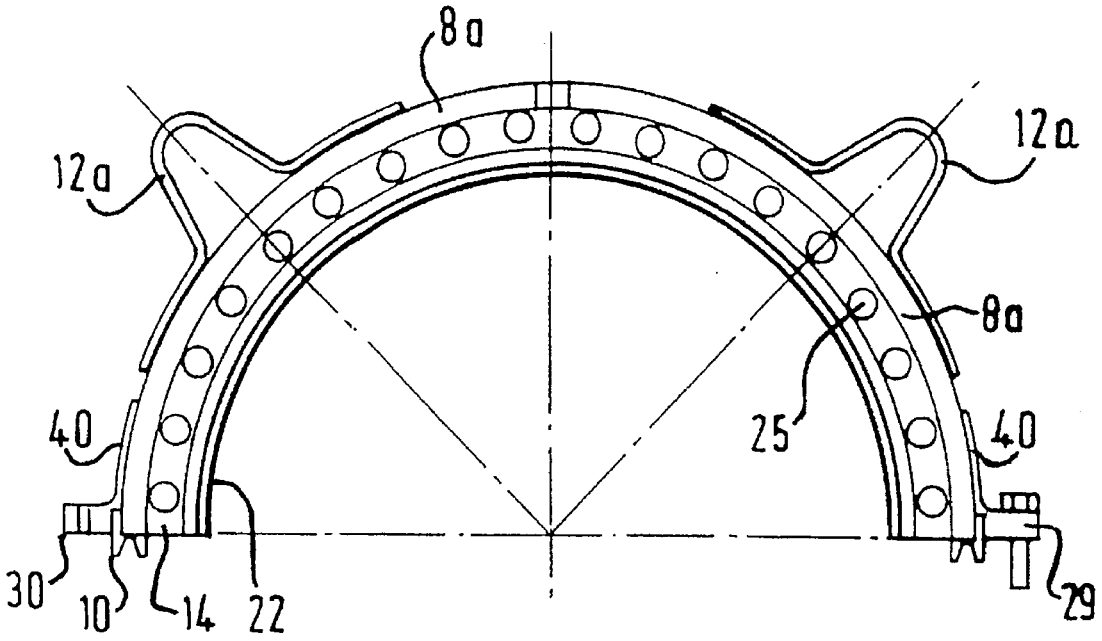
FIG. 5 is a section view through a collar.

FIG. 5 is a section through the intermediate ring 14 positioned on the barrel (not shown) by means of the washer 22, and provided with its communication holes 25. The half-shell 8*a* is applied to the outside surface of the ring, as explained above. The half-shell is engaged in the H-section bar 10 and is provided on its outside surface with Ω-section bars 12 and with male portions 29 and female portions 30 that form a coupling collar 11. The complementary half-shell has the same elements. Each collar 11 has a tab 40 welded to the outside surface of the half-shell. The tab 40 receives the male or female portion as the case may be. On assembly, the corresponding half-shells are placed face to face by causing the male and female parts to mate, and they are held together, e.g. by screw threads.

Figure 6:
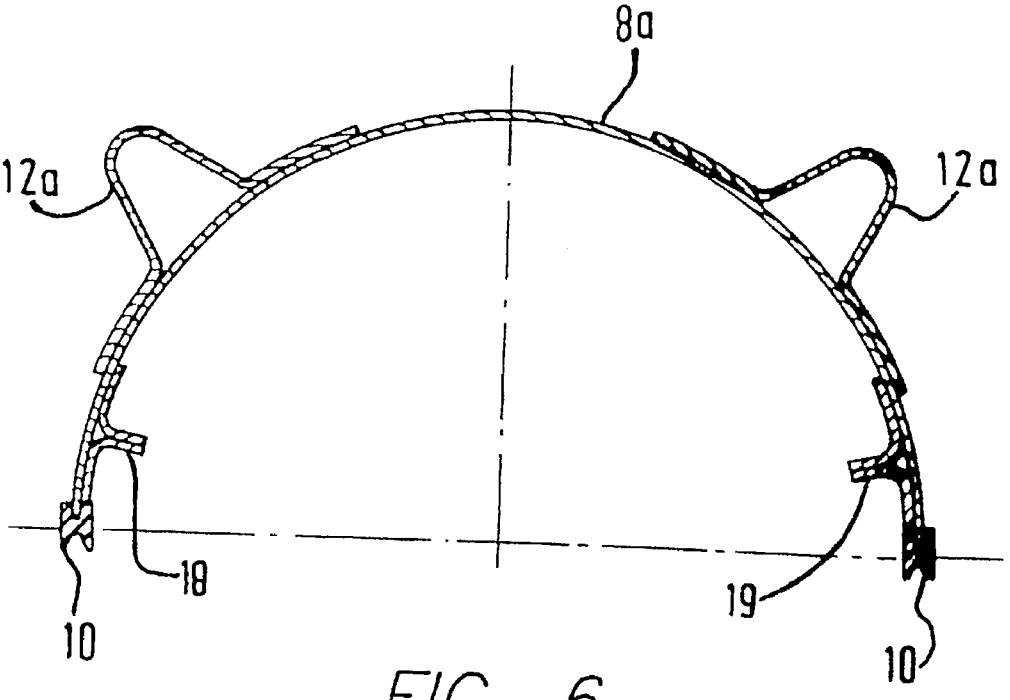
FIG. 6 is a cross-section view through the envelope.

FIG. 6 is a cross-section through a half-shell 8*a*, e.g. having two Ω-section reinforcing members 12*a* applied to its outside and two T-section reinforcing members 19 applied to its inside. There can also be seen the H-section connection means 10 for connecting the half-shell 8*a* to the corresponding half-shell which is not shown.

We claim:

1. An anti-buckle fitting for a gun barrel, the fitting being constituted by an envelope that surrounds the barrel at a distance therefrom and of a length that is substantially equal to the outside portion of the barrel, the fitting comprising a front ring fixed near a free end of the barrel and a back ring fixed near a fume extractor of the barrel, and wherein the envelope is in the form of two half-shells assembled together by link means, wherein each half-shell is provided with external reinforcing means.

2. An anti-buckle fitting according to claim 1, wherein each ring is provided with a groove for receiving the envelope.

3. An anti-buckle fitting according to claim 1, wherein the two half-shells are provided on their adjacent edges with connection means.

4. An anti-buckle fitting according to claim 1, wherein each half-shell is provided with holes for allowing air to flow between the inside volume defined by the half-shells and the barrel, and the outside.

5. An anti-buckle fitting according to claim 1, wherein each half-shell has a section of semicircular outline.

6. An anti-buckle fitting according to claim 5, wherein the envelope is tapering in shape, with its larger base being constituted by its back ring.

7. An anti-buckle fitting for a gun barrel, the fitting being constituted by an envelope that surrounds the barrel at a distance therefrom and of a length that is substantially equal to the outside portion of the barrel, the fitting comprising a front ring fixed near the free end of the barrel and a back ring fixed near the fume extractor of the barrel, and wherein the envelope is in the form of two half-shells assembled together by link means, wherein the two half-shells are provided on their adjacent edges with connection means, wherein the connection means is constituted by an H-section bar.

8. An anti-buckle fitting for a gun barrel, the fitting being constituted by an envelope that surrounds the barrel at a distance therefrom and of a length that is substantially equal to the outside portion of the barrel, the fitting comprising a front ring fixed near the free end of the barrel and a back ring fixed near the fume extractor of the barrel, and wherein the envelope is in the form of two half-shells assembled together by link means, including at least one intermediate ring disposed substantially in the middle of the envelope and provided on either side with respective grooves receiving the ends of two envelope elements.

9. An anti-buckle fitting according to claim 8, wherein the intermediate ring is applied directly to the barrel by clamping.

10. An anti-buckle fitting according to claim 9, wherein an insulating washer, e.g. made of rubber, is disposed between the intermediate ring and the barrel.

11. An anti-buckle fitting according to claim 8, including two intermediate rings.

12. An anti-buckle fitting according to claim 11, wherein each intermediate ring is provided with longitudinal holes putting into mutual communication the subassemblies defined by the envelope, the front rings, the back rings, and the intermediate ring(s).

13. An anti-buckle fitting for a gun barrel, the fitting being constituted by an envelope that surrounds the barrel at a distance therefrom and of a length that is substantially equal to the outside portion of the barrel, the fitting comprising a front ring fixed near a free end of the barrel and a back ring fixed near a fume extractor of the barrel, and wherein the envelope is in the form of two half-shells assembled together by link means, wherein each half-shell is provided with internal reinforcing means.

14. An anti-buckle fitting according to claim 13, wherein the internal reinforcing means is constituted by a T-section bar, and the external reinforcing means is constituted by a bar having an Ω-shaped right section.

15. An anti-buckle fitting according to claim 14, wherein the half-shells, and the H-, T-, and Ω-section bars are all made from metal sheet using a folding technique.

* * * * *